United States Patent [19]

Smagunova et al.

[11] 4,212,708

[45] Jul. 15, 1980

[54] GOLD-PLATING ELECTROLYTE

[76] Inventors: Nina A. Smagunova, ulitsa Mishina, 12, kv. 8; Nina M. Dyatlova, 2 Samotechny pereulok, 4, korpus 1, kv. 4; Alexandr Y. Fridman, Kirovogradskaya ulitsa, 24, kv. 76; Elena V. Shemyakina, Bolshoi Savvinsky pereulok, 19, kv. 3; Vera Y. Temkina, ulitsa Alabiana, 3, kv. 108; Ljudmila K. Nikerova, 3 Frunzenskaya ulitsa, 1, kv. 93; Alexandr V. Belikin, ulitsa Vilisa Latsisa, 4, korpus 2, kv. 208, all of Moscow, U.S.S.R.

[21] Appl. No.: 45,848

[22] Filed: Jun. 5, 1979

[51] Int. Cl.[2] ..... C25D 3/48

[52] U.S. Cl. ..... 204/46 G; 204/43 G; 204/DIG. 2

[58] Field of Search ..... 204/43 G, 46 G

[56] References Cited

U.S. PATENT DOCUMENTS

| | | | |
|---|---|---|---|
| 3,475,292 | 10/1969 | Shoushanian | 204/44 |
| 3,666,640 | 5/1972 | Smith | 204/44 |
| 3,787,463 | 1/1974 | Zuntini et al. | 204/46 G X |
| 3,878,068 | 4/1975 | Bick et al. | 204/46 G |
| 3,893,896 | 7/1975 | Korbelak et al. | 204/44 |
| 3,904,493 | 9/1975 | Losi et al. | 204/43 G |
| 3,933,602 | 1/1976 | Henzi et al. | 204/44 |
| 4,062,736 | 12/1977 | Meyer et al. | 204/43 G |

*Primary Examiner*—F. C. Edmundson
*Attorney, Agent, or Firm*—Steinberg & Blake

[57] ABSTRACT

The gold-plating electrolyte of the present invention contains the components in the following proportions, g/l:

hexapotassium $\mu$-ethylenediaminotetracetate bis(aurous sulphite):10.5–123.0 a salt of an alkali metal of ethylenediaminotetracetic acid: 17.8–140.0 potassium sulphate:12.6–11.0 potassium hydrogen phosphate:4.7–40.0 water:the balance

The gold-plating electrolyte of this invention is useful in the preparation of gold reactants for electronics, watchmaking, jewelry, radio-engineering.

2 Claims, No Drawings

GOLD-PLATING ELECTROLYTE

The present invention relates to the preparation of gold compounds and, more specifically, it relates to a gold-plating electrolyte.

FIELD OF THE INVENTION

The present invention is useful in the preparation of gold reactants for electronics, watch making, jewelry and radio-engineering.

BACKGROUND OF THE INVENTION

Known in the art are gold-plating electrolytes based on sodium or potassium dicyanoaurate and containing also potassium sulphate, potassium hydrogen phosphate, an alkali metal salt of ethylenediaminoacetic acid which are prepared by anodic or chemical dissolution of gold in solutions of alkali metal cyanides.

Preparation and use of this type electrolytes are associated with evolution of toxic compounds and the necessity of making them harmless. Said prior art electrolytes make it possible to obtain a good-quality coating only at large thicknesses thereof.

Preparation and use of said prior art gold-plating electrolytes is also accompanied by difficulties encountered in recovery of gold from spent and mother liquors and outgassing of toxic compounds.

Most widely employed gold-plating electrolytes are based on disulphitoaurate, ethylenediaminodisulphitoaurate and diaminodisulphitoaurate of alkali metals; properties of these gold-plating electrolytes depend on the method of preparing same. This method comprises conversion of aurichlorohydric acid to a sparingly soluble gold compound, auric hydroxide or auric ammoniate to purify from $Cl^-$ions; this gold compound is treated with solutions of sulphites of alkali metals, followed by stabilization of the resulting sulphite complexes in the solution.

The thus-produced sparingly soluble gold compounds are low-stable thus causing a partial evolution of metal gold which, in turn, lowers the desired product yield. This also hinders preparation of highly-concentrated electrolytes for gold-plating which would be stable in storage and use, whereby the efficiency of the gold-plating process is educed.

Known in the art is a gold-plating electrolyte (cf. U.S. Pat. No.3,893,896) based on potassium disulphitaurate and having the following composition:

$K_3[Au(SO_3)_2]$: 6.8–68
$Na_2H_2Edta$: 0.1–100
$K_2SO_4$: 1.0–100
$K_2HPO_4$: 10–40
water: the balance (current density is $D_k = 0.1–1.2$ A/dm$^2$; T = 18°–80° C.).

This gold-plating electrolyte has a throwing power of up to 90%, yield current up to 70–80%, period of storage at the temperature of 25°0 C. as long as 4 months, starting point of decomposition at $D_k$ above 0.8 A/dm$^2$.

This electrolyte ensures the manufacture of high-quality fine coatings with Vickers hardness of from 80 to 220 kg/mm$^2$, porosity of from 25 to 30 pores/cm$^2$ at the thickness of 15 mcm and non-porous at a thickness of below 5 mcm.

The process for the preparation of this electrolyte comprises treatment of aurichlorohydric acid with a solution of ammonia at a pH of from 3 to 6 to give basic auric ammoniate, followed by decantation of the mother liquor and washing in hot water. The resulting suspension is added to a hot solution of potassium sulphite (to the concentration of 150 g/l), followed by heat-treatment of the resulting mixture at a temperature ranging from 70° to 90° C. for a period of from 48 to 72 hours and addition of an alkali metal salt of ethylenediaminetetracetic acid, potassium sulphate and potassium hydrogen phosphate. The resulting eletrolyte is filtered-off to recover partly precipitated metallic gold. The yield of the thus-produced gold-plating electrolyte is 30 to 60% as calculated for metal gold.

This prior art gold-plating electrolyte has a reduced stability in storage and use, as well as insufficient technological parameters.

SUMMARY OF THE INVENTION

It is the main object of the present invention to provide a gold-plating electrolyte possessing improved technological parameters and a high stability in storage and use.

This object is accomplished by that a gold-plating electrolyte which contains a complex gold compound with sulphite-ion, an alkali metal salt of ethylenediaminetetracetic acid, potassium hydrogen phosphate, potassium sulphate and water, in accordance with the present invention contains, as the complex gold compound with sulphite-ion, hexapotassium μ-ethylenediaminetetracetate bis(gold sulphite /1/) with the following proportions of the components (g/l):

hexapotassium μ-ethylenediaminetetracetate bis(gold sulphite /1/): 10.5–123.0
an alkali metal salt of ethylenediaminetetracetic acid: 17.8–140.0
potassium sulphate: 12.6–110.0
potassium hydrogen phosphate: 4.7–40.0
water: the balance Quantitative content of the components in the electrolyte is determined by that at a content of hexapotassium μ-ethylenediaminotetracetate bis(aurous sulphite )below 10.5 g/l, the rate of electrodeposition is insufficient, while at a content thereof above 123 g/l the quality of coatings is impaired. Proportions of the alkali metal salt of ethylenediaminetetracetic acid, potassium sulphate and potassium hydrogen phosphate affect the quality of coatings, in particular hardness thereof; these properties are defined by the content of hexapotassium μ-ethylenediaminetetracetate bis(aurous sulphite).

It is advisable that the gold-plating electrolyte according to the present invention contain the components in the following proportions, g/l:

hexapotassium μ-ethylenediaminetetracetate bis(aurous sulphite): 10.5–25.0
disodium-dipotassium salt of ethylenediaminetetracetic acid: 17.8–40.0
potassium sulphate: 12.6–28.4
potassium hydrogen phosphate: 4.7–10.4
water: the balance The above-specified amounts of the components of the optimal gold-plating electrolyte composition ensure a maximum reliability thereof in use. Thus, $K_2Na_2Edta$ in said amounts inhibits dissociation of ethylenediaminetetracetateion $K_6[Au(SO_3)_2Edta]$ under the effect of the electric field forces in the layer adjacent to the electrode. In this case the electrochemical reaction proceeds only in a double electric layer and prevents spontaneous decomposition of the complex within the solution volume accompanied by liberation of gold in the powder-like form. $K_2SO_4$ in the above-specified amounts ensures the most acceptable process electrical conductivity of the solution. $K_2HPO_4$ in the above-specified amounts creates buffer character of the medium. This is necessary due to the fact that at the anode the following reaction occurs:

$$SO_3^{2-} + H_2O \xrightarrow{-2\bar{e}} SO_4^{2-} + 2H^+,$$

wherefore acidification of the medium can take place thus resulting in the complex decomposition in the solution.

DETAILED DESCRIPTION OF THE INVENTION

Properties of the gold-plating electrolyte according to the present invention are imparted thereto owing to the method of its preparation.

To prepare the electrolyte, solutions of ammonium hydrogen phosphate and aurihydrochloric acid are simultaneously added to water at a temperature of from 70° to 95° C. at such a rate that a pH of the resulting suspension be within the range of from 4.5 to 6.0. Therewith, a precipitate is formed which consists of bis-(dihydroxyphosphatomonohydroxyphosphato)ammonium aurate pentahydrate of the formula:

$$(NH_4)_3[Au(HPO_4)_2(H_2PO_4)_2].5H_2O$$

The precipitate is washed to remove chlorides using filtration or decantation methods and then portion-wise added to a solution containing of an alkali metal salt of ethylenediaminetetracetic acid and caustic potash at a pH of 9–10 and temperature ranging from 70° to 90° C. Upon the reaction of the insoluble complex $(NH_4)_3[Au(HPO_4)_2(H_2PO_4)_2].5H_2O$ with this solution there occurs a partial dissolution of the precipitate with the formation of a soluble ethylenediaminetetracetate complex of trivalent gold. Afterwards, the resulting suspension is added with a solution containing potassium sulphite and caustic potash at the pH of 9. The abovementioned soluble complex reacts with sulphite-ions accompanied by reduction of trivalent gold to monovalent gold and the formation of the sulphite complex of $K_6[Au(SO_3)_2Edta)]$.

All these processes result in shifting the equilibrium towards dissolution of the precipitate, while the abovementioned stages exclude by-processes resulting in decomposition of complexes of monovalent gold to metallic gold.

The yield of electrolyte as calculated for gold is 86%.

This high yield of the gold-plating electrolyte according to the present invention is due to the fact that use is made of ammonium hydrogen phosphate for precipitation of a hardly soluble complex compound of gold. This precipitation product has a permanent composition $(NH_4)_3[Au(HPO_4)_2.(H_2PO_4)_2].5H_2O$, and ensures reproducibility of preparation of the gold-plating electrolyte in contrast to the precipitation product obtained by means of ammonia known as fulminating gold and having no permanent composition. The complex $(NH_4)_3[Au(HPO_4)_2.(H_2PO_4)_2].5H_2O$ is insoluble in an excess of ammonium hydrogen phosphate which makes it possible to ensure a full precipitation of gold. This complex comprises an easily precipitated compact powder which is not decomposed both in the wet and dry state in contrast to the very unstable and hazardous in the wet and especially in the dry condition fulminating gold; this makes it possible to use filtration and washing on the filter to effect purification from chlorides instead of multiple decantations in the case of fulminating gold. Upon the subsequent dissolution of said complex, phosphates which are one of the components of the gold-plating electrolyte according to the present invention pass into the solution. Thus, the choice of ammonium hydrogen phosphate as a precipitation agent ensures lesser losses of gold due to a more complete deposition thereof, lesser mechanical losses owing to filtration instead of multiple decantation, as well as absence of metallic gold in the precipitate which is due to the chemical stability of the complex $(NH_4)_3[Au(HPO_4)_2.(H_2PO_4)_2].5H_2O$ and, owing thereto, lesser losses of gold in the subsequent operations.

The resulting gold-plating electrolyte has the following composition, g/l:

$K_6[Au(SO_3)_2Edta]$: 10.5–123
$K_2Na_2Edta$: 17.8–140
$K_2SO_4$: 12.6–110
$K_2HPO_4$: 4.7–40
water: the balance Advisable conditions for the precipitation are as follows: temperature within the range of from 18° to 60° C.; cathodic current density $D_k$=0.02–15.0 A/dm$^2$ for substrates from copper, brass, bronze, nickel and stainless steel (without preliminary nickel-plating); anodes-stainless steel, platinum, graphite.

The gold-plating electrolyte according to the present invention possesses a throwing power of up to 80%, yield current of 80–90%, time of storage at the temperature of 25° C. more than 12 months, start point of the electrolyte decomposition $D_k$=15 A/dm$^2$. This gold-plating electrolyte ensures preparation of high-quality fine coatings with a Vickers hardness of from 80 to 220 kg/mm$^2$, porosity of 15 to 20 pores per cm$^2$ at the thickness of 15 mcm and poreless at a thickness of up to 5 mcm.

The gold-plating electrolyte according to the present invention possesses improved process parameters as compared to the prior art gold-plating electrolytes, as well as a high stability in storage and use and a high yield for gold in the preparation.

Given hereinbelow are some specific examples illustrating the gold-plating electrolyte according to the present invention and the method for preparing same.

EXAMPLE 1

In 1,500 ml there are dissolved 5 g of ammonium hydrogen phosphate and the solution is heated to the temperature of 85° C., whereafter it is added, under stirring for 30 minutes, simultaneously with a solution containing 76.3 g of aurichlorohydric acid, 15 ml of hydrochloric acid and 250 ml of water and a solution containing 35 g of ammonium hydrogen phosphate and 250 ml of water. The addition of said solutions should be effected at such a rate that the pH value of the resulting suspension be equal to 6.0. The precipitated $(NH_4)_3[Au(HPO_4)_2.(H_2PO_4)_2].5H_2O$ is filtered-off and washed with 500 ml of water, whereafter it is mixed with 200 ml of water to form a suspension. The thus-prepared suspension is portion-wise (by portions of 20 ml) is added to a solution containing 140 g of disodium salt of ethylenediaminetetracetic acid dihydrate and caustic potash to the pH of 9.0 in 500 ml of water at the temperature of 70° C. The resulting mixture is portion-wise added with a solution (portions of 20–25 ml) containing 110 g of potassium sulphite in 500 ml of water for 20 minutes till a complete dissolution of the precipitate. The resulting gold-plating electrolyte comprising a concentrate suitable for use per se and for the preparation of less concentrated gold-plating electrolytes contains, g/l:

$K_6[Au(SO_3)_2Edta]$: 123
$K_2Na_2Edta$: 52
$K_2SO_4$: 40
$K_2HPO_4$: 40
water: the balance Preparation of less concentrated electrolytes is performed by dilution of the concentrate with water and addition of other components to the concentration: of potassium sulphate to 110 g/l, potassium hydrogen phosphate to 40 g/l, disodium-dipotassium salt of ethylenediaminetetracetic acid to 140 g/l.

The gold-plating electrolyte of this Example has the following characteristics:

throwing power: 90%
current yield: 80%
storage time at 25° C.: more than 12 months
starting point of decomposition: $D_k$ above 15 A/dm$^2$ The use of this solution (concentrate) on substrates of copper, nickel and stainless steel at the temperature of 20° C. and $D_k$=0.01 A/dm$^2$ results in deposition of poreless coatings with the thickness of up to 7 mcm at the rate of 5 mcm/hr. Optimal conditions of the deposition are the following: temperature 20° to 60° C., $D_k$=0.2–0.6 A/dm$^2$, rate of deposition 8 to 14 mcm/hr. The coatings obtained under said optimal conditions are non-porous at a thickness of up to 5 mcm; in thicker layers they have porosity of from 15 to 20 pores/cm$^2$ depending on the deposition conditions.

EXAMPLE 2

To prepare a gold-plating electrolyte containing, g/l:

$K_6[Au(SO_3)_2Edta]$: 10.5
$K_2Na_2Edta$: 17.8
$K_2SO_4$: 12.6
$K_2HPO_4$: 4.7
water: the balance, the concentrate of Example 1 in the amount of 85 ml (prepared following the procedure of the foregoing Example 1 except that deposition of $(NH_4)_3[Au(HPO_4)_2.(H_2PO_4)_2].5H_2O$ is effected at the pH of 4.5 and temperature of 95° C. and dissolution of the resulting precipitate is conducted at the temperature of 90° C. and pH=10) is added with 915 ml of water, 13.4 g of disodium-dipotassium salt of ethylenediaminetracetic acid, 9.3 g of potassium sulphate, 5.3 g of potassium hydrogen phosphate and the solution is stirred at room temperature.

The resulting gold-plating electrolyte has the following characteristics:

throwing power: 80%
current yield: 80%
time of storage at 25° C.: above 12 months
starting point of decomposition: at $D_k$=15 A/dm$^2$ The deposition is effected in the electrolyte prepared as above at the rate of 12 mcm/hr on brass, copper and nickel at the temperature of 40° C., $D_k$=0.4 A/dm$^2$. There are obtained glossy coatings with a thickness of up to 50 mcm. The porosity value is 15 pores/cm$^2$. Vickers hardness is 220 kg/cm$^2$.

EXAMPLE 4

A gold-plating electrolyte containing, g/l:

$K_6[Au(SO_3)_2Edta]$: 48.7
$Na_2K_2Edta$: 140
$K_2SO_4$: 110
$K_2HPO_4$: 18.7
water: the balance is prepared by the addition, to 333 ml of the concentrate prepared as in Example 1 hereinbefore, of 667 ml of water, 97 g of potassium sulphate and 123 g of disodium-dipotassium salt of ethylenediamine-tetracetic acid. The resulting gold-plating electrolyte has the following characteristics:

throwing power: 90%
current yield: 80%
time of storage at 25° C.: over 12 months
starting point of decomposition: at $D_k$=16.2 A/dm$^2$ Glossy coatings are deposited at the temperature of 40° C., $D_k$=0.3 A/dm$^2$ at the rate of 12 mcm/hr on brass, nickel, bronze and stainless steel with a thickness of up to 100 mcm. On brass, bronze, nickel the coating are non-porous at the thickness of up to 5 mcm; on stainless steel at the same thickness porosity is 5 pores/cm$^2$. Vickers hardness is 80 kg/mm$^2$.

EXAMPLE 5

To prepare a gold-plating electrolyte containing, g/l:

$K_6[Au(SO_3)_2Edta]$: 18.9
$K_2Na_2Edta$: 32.2
$K_2SO_4$: 22.7
$K_2HPO_4$: 8.0
water: the balance to 153 ml of a concentrate prepared as in Example 1 hereinbefore there are added 23.4 g of disodium-dipotassium salt of ethylenediaminetetracetic acid, 6.6 g of potassium sulphate, 1.9 g of potassium hydrogen phosphate and water to add to 1 liter.

The resulting gold-plating electrolyte has the following characteristics:

throwing power: 90%
current yield: 84%
time of storage at 25° C.: over 12 months
starting point of decomposition: $D_k$=16 A/dm$^2$ The deposition is effected at the temperature of 45° C. and $D_k$=0.4 A/dm$^2$ from the thus-prepared electrolyte on substrates of brass, stainless steel. Porosity of the resulting coatings is 23 pores/cm$^2$ at the thickness of 15 mcm; Vickers hardness is 165 kg/mm$^2$.

EXAMPLE 6

A gold-plating electrolyte containing, g/l:

$K_6[Au(SO_3)_2Edta]$: 25.0
$Na_2K_2Edta$: 40.0
$K_2SO_4$: 28.4
$K_2HPO_4$: 12.4
water: the balance is prepared by the addition, to 310 ml of the concentrate prepared as in the foregoing Example 1, of 23 g of disodium-dipotassium salt of ethylenediaminetetracetic acid, 16.4 g of potassium sulphate and water to 1 liter.

The resulting gold-plating electrolyte has the following characteristics:

throwing power: 80%
current yield: 90%
time of storage at 25° C.: above 12 months
starting point of decomposition: $D_k$=15.8 A/dm$^2$ The deposition is effected in the thus-prepared electrolyte at the temperature of 60° C. and $D_k$=0.2 A/dm$^2$ on substrates of brass, and stainless steel. Porosity of the resulting coatings is 30 pores/cm$^2$ at the thickness of 15 mcm; Vickers hardness is 100 kg/mm$^2$.

Electrodeposition of gold from the electrolytes of Examples 1 to 5 is conducted in electrolytic cells of any conventional design.

In all the above Examples utilization of gold from spent electrolytes is effected by the addition of sulphuric acid thereto to a pH of below 3–4, followed by heating to a temperature of 50°–60° C. and filtration of the precipitated powder-like gold.

What is claimed is:

1. A gold-plating electrolyte containing the ingredients in the following proportions, g/l:

hexapotassium μ-ethylenediaminotetracetate bis(gold sulphite /l/): 10.5–123.0
an alkali metal salt of ethylenediaminotetracetic acid: 17.8–140.0
potassium sulphate: 12.6–110.0
potassium hydrogen phosphate: 4.7–40.0
water: the balance 2. A gold-plating electrolyte according to claim 1, containing the ingredients in the following proportions, g/l:

hexapotassium μ-ethylenediaminotetracetate bis(gold sulphite /l/): 10.5–25.0
disodium-dipotassium salt of ethylenediaminotetracetic acid: 17.8–40.0
potassium sulphate: 12.6–28.4
potassium hydrogen phosphate: 4.7–10.4
water: the balance.

* * * * *